US012644355B1

(12) United States Patent
Dachepally et al.

(10) Patent No.: US 12,644,355 B1
(45) Date of Patent: Jun. 2, 2026

(54) ANTI-EXTRUSION ELEMENT WITH OVERLAPPING SEGMENTS

(71) Applicant: Halliburton Energy Services, Inc., Houston, TX (US)

(72) Inventors: Nithin Kumar Gupta Dachepally, Singapore (SG); Jalpan Piyush Dave, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/315,341

(22) Filed: Aug. 29, 2025

(51) Int. Cl.
*E21B 33/12* (2006.01)
*E21B 33/128* (2006.01)

(52) U.S. Cl.
CPC ..... *E21B 33/1216* (2013.01); *E21B 33/128* (2013.01)

(58) Field of Classification Search
CPC ..... E21B 33/1216; E21B 33/128; E21B 33/1208; F16J 15/166
See application file for complete search history.

(56) References Cited

U.S. PATENT DOCUMENTS

| | | | | |
|---|---|---|---|---|
| 7,178,602 | B2 | 2/2007 | Hiorth et al. | |
| 9,528,341 | B2 | 12/2016 | Slup | |
| 10,253,592 | B2 | 4/2019 | Ingram et al. | |
| 10,612,339 | B2 | 4/2020 | Murphy | |
| 11,492,869 | B2 | 11/2022 | Urban et al. | |
| 11,542,775 | B2 | 1/2023 | Horne et al. | |
| 2002/0043368 | A1* | 4/2002 | Bell | E21B 33/1216 166/134 |
| 2019/0120011 | A1 | 4/2019 | Kellner | |
| 2022/0081991 | A1* | 3/2022 | Deng | E21B 33/128 |

* cited by examiner

*Primary Examiner* — George S Gray
(74) *Attorney, Agent, or Firm* — The Hilton Firm PLLC

(57) ABSTRACT

Anti-extrusion elements to prevent extrusion of a sealing element during compression. The anti-extrusion element has a series of inner segments forming a loop bent to form a slot running along the circumference of the anti-extrusion element. The slot opens and faces radially outward away from the loop. Each inner segment has two ends on opposing sides aligned to form an opening between two inner segments. The anti-extrusion element additionally has a series of outer segments adjacent to one another to form a loop and slot. The series of inner segments is nested within the slot of the series of outer segments. Each outer segment comprises a peg within the slot and each peg aligns with a corresponding opening such that one peg protrudes through one opening. The anti-extrusion element additionally has a plurality of springs in the slot of inner segments and the springs are coupled to the pegs.

20 Claims, 7 Drawing Sheets

ANTI-EXTRUSION ELEMENT WITH OVERLAPPING SEGMENTS

TECHNICAL FIELD

The present disclosure relates generally to wellbore operations, and more particularly, to the use of an anti-extrusion element having overlapping segments to prevent extrusion of a sealing element during compression.

BACKGROUND

For some wellbore operations, it may be desirable to seal off one wellbore location from others. One method of sealing is to use a packer assembly to seal a portion of the wellbore. Packer assemblies generally comprise sealing elements that compress and deform to contact an adjacent surface and form a seal. These sealing elements are subject to differential pressures when compressed. This differential pressure may extrude the material of the sealing element of the packer assembly as the sealing element is compressed. An extruded sealing element may impact seal integrity as well as prevent repeated setting and unsetting of the packer assembly. Moreover, an extruded sealing element may also impact multiple set and unset operations during a single run when using retrievable packers.

The use of a sealing element may be an important part of a wellbore operation. It may be desirable to set, unset, and reset a sealing element during a wellbore operation without extrusion of the sealing element. The present disclosure provides improved anti-extrusion elements for assisting with sealing in a wellbore.

BRIEF DESCRIPTION OF THE DRAWINGS

Illustrative examples of the present disclosure are described in detail below with reference to the attached drawing figures, which are incorporated by reference herein, and wherein.

Figure 1:
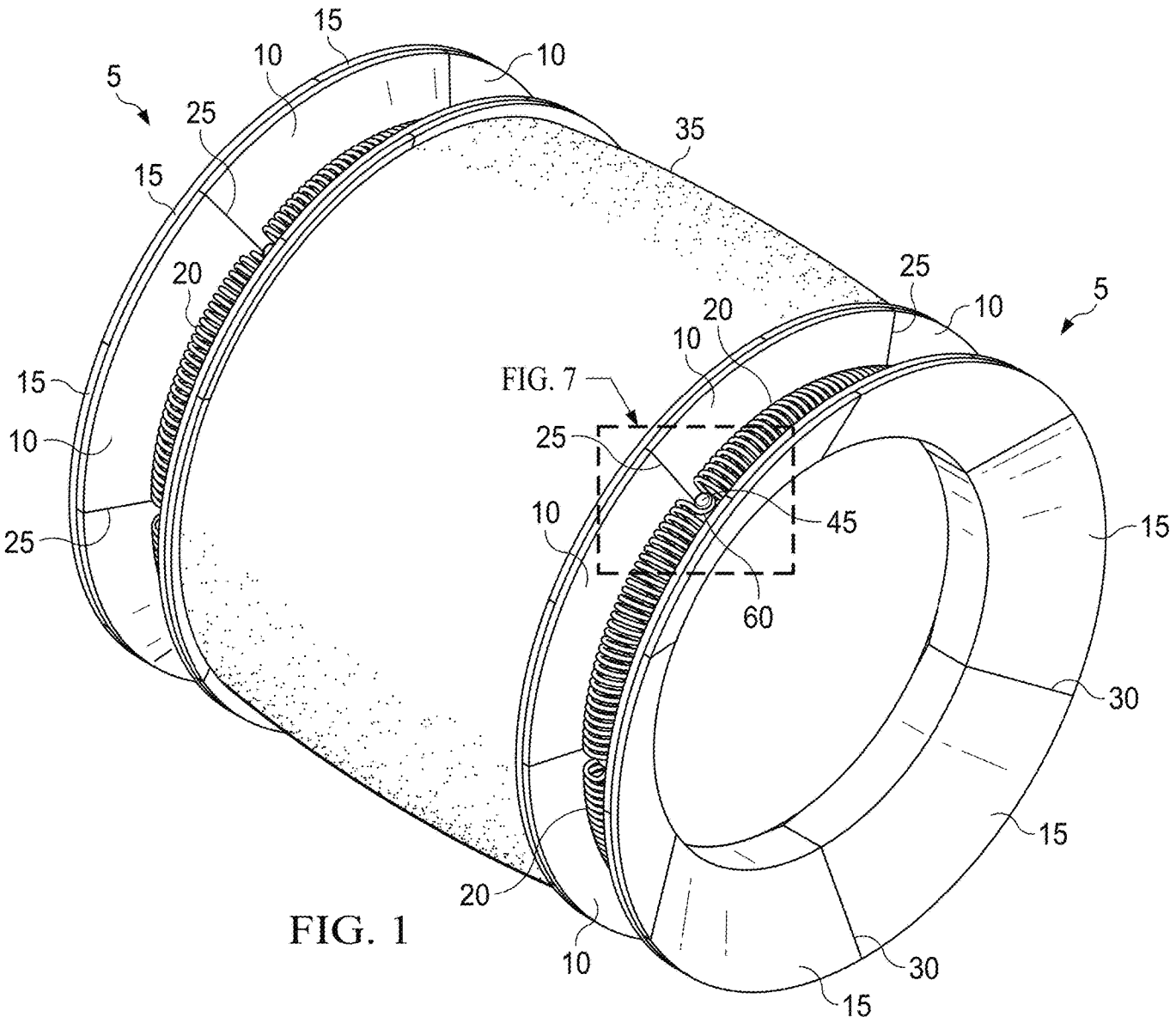
FIG. 1 is a perspective drawing of two example anti-extrusion elements in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to wellbore operations, and more particularly, to the use of an anti-extrusion element having overlapping segments to prevent extrusion of a sealing element during compression.

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Accordingly, unless indicated to the contrary, the numerical parameters set forth in the following specification and attached claims are approximations that may vary depending upon the desired properties sought to be obtained by the examples of the present invention. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms "uphole" and "downhole" may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

The terms "upstream" and "downstream" may be used to refer to the location of various components relative to one another in regards to the flow of a sample through said components. For example, a first component described as upstream from a second component will encounter a sample before the downstream second component encounters the sample. Similarly, a first component described as being downstream from a second component will encounter the sample after the upstream second component encounters the sample.

The present disclosure relates generally to wellbore operations, and more particularly, to the use of an anti-extrusion element having overlapping segments to prevent extrusion of a sealing element during compression. Advantageously, the anti-extrusion elements disclosed herein may minimize or prevent extrusion of a sealing element located proximate to the anti-extrusion element. The anti-extrusion element comprises a series of overlapping inner segments nested within a series of overlapping outer segments forming a loop which may be positioned onto a mandrel or any type of suitable wellbore conduit. The series of inner segments and the series of outer segments are bent to form a slot running along the circumference of the anti-extrusion element. As a further advantage, the ends of the series of overlapping inner segments do not align with the ends of the series of overlapping outer segments. As the series of overlapping inner segments and overlapping outer segments do not have aligned ends, pressure against the anti-extrusion element by the material of the sealing element will reduce the probability of extrusion of the sealing element through the anti-extrusion element as there is no aligned gap between the ends of the series of overlapping inner segments and overlapping outer segments. Additionally, the anti-extrusion element comprises a plurality of springs disposed in the slots of the series of inner segments. The springs are coupled with pegs protruding through the series of inner segments from the series of outer segments. The arrangement of the springs within the slots of the series of inner segments allows the anti-extrusion element to expand and retract radially upon application of a force in the axial direction of the anti-extrusion element and the sealing element. For example, application of a sufficient setting force by a setting tool on the anti-extrusion element will push the series of outer segments onto the setting tool, which causes the anti-extrusion element to expand radially. The axial force is also transmitted onto the other side of the anti-extrusion element to the sealing element. Moreover, the continued application of axial force will also be transmitted through the sealing element to a structure on the other side of the sealing element. For example, a second anti-extrusion element on the opposing side of the sealing element will also radially expand upon application of the transmitted axial force. As the two anti-extrusion elements expand radially, they contact an adjacent surface (e.g., a casing) and reduce the extrusion gap for the sealing element to extrude through. When both anti-extrusion elements on either side of the sealing element have radially expanded, the sealing element will then be compressed upon application of further axial force thereby inducing radial expansion of the sealing element. The sealing element is compressed and expanded last as the stiffness of the sealing element material is greater than the stiffness of the plurality of springs of the anti-extrusion elements. The radially expanded sealing element contacts an adjacent surface to form a seal and isolate the wellbore locations or zones on either side of the sealing element. Advantageously, the anti-extrusion element creates, at most, a negligible gap on either side of the sealing element, and extrusion of the sealing element due to the applied setting force is minimized or prevented. As a still further advantage, the anti-extrusion element may also provide support to the sealing element under high pressure and/or high temperature environments.

The anti-extrusion element may be used in any sealing operation in a wellbore. For example, the anti-extrusion element may be used during any part of the drilling, completion, or production processes when zonal isolation is desired. The anti-extrusion element may be of particular usefulness in sealing operations conducted in high temperature and/or high pressure wellbore environments where the probability of extrusion of the sealing element may be increased.

FIG. 1 illustrates a perspective drawing of two example anti-extrusion elements, generally 5. An anti-extrusion element 5 comprises a series of overlapping inner segments 10, a series of overlapping outer segments 15, and a plurality of springs 20. The series of overlapping inner segments 10 is a series in which each inner segment 10 in the series is adjacent to another inner segment 10 in the series such that the series of inner segments 10 forms a loop of abutting inner segments 10. As used herein, the term "abut" and all of its variations does not necessarily mean that physical contact is made between two abutting segments. "Abutting" segments are segments that are adjacent or proximate to one another and may or may not be in direct physical contact with one another. Abutting segments are used to minimize the extrusion gap in the deployed state but, it is not necessary to have the abutting segments directly contact one another to operate the anti-extrusion element and there may be a small gap between the abutting inner segments and/or the abutting outer segments. Each of the inner segments 10 in the series is bent to form a slot running along the circumference of the anti-extrusion element 5. In some examples, the series of inner segments 10 could be cut into parts out of a full circular slotted ring, instead of bending separate segments 10 to form the loop. The slot is open and faces radially outward away from the loop. Each inner segment 10 has two ends 25 on opposing sides of the axial length of each inner segment 10 and each end 25 comprises a groove running inward away from the end 25; wherein the groove of one end 25 of each inner segment 10 aligns with a corresponding groove of an end 25 of the adjacent inner segment 10 so as to form an opening.

With continued reference to FIG. 1, the series of outer segments 15 is a series with each outer segment 15 in the series being adjacent to another outer segment 15 in the series such that the series of outer segments 15 forms a loop of abutting outer segments 15. Each outer segment 15 has two ends 30 on opposing sides of the circumference of the anti-extrusion element 5. Each of the outer segments 15 in the series is bent to form a slot running along the axial length of each outer segment 15. In some examples, the series of inner segments 10 could be cut into parts out of a full circular slotted ring instead of bending separate segments 10 to form the loop. The slot is open and faces radially outward away from the loop. The series of inner segments 10 are disposed within the slots of the series of outer segments 15 such that the series of inner segments 10 is nested within the slots of the series of outer segments 15. The ends 25 of the series of inner segments 10 and the ends 30 of the series of outer segments 15 do not align which may prevent extrusion of the material of an adjacent sealing element.

Continuing with FIG. 1, a plurality of springs 20 are disposed within the slots of the series of inner segments 10. One spring 20 in the plurality is disposed in one slot of an inner segment 10 so that each inner segment 10 in the series has a spring 20 disposed in its respective slot.

A sealing element 35 is disposed between the two anti-extrusion elements 5. The sealing element 35 and the two anti-extrusion elements 5 may be positioned on a mandrel, wellbore conduit, wellbore tool, etc. and then introduced into a wellbore. When a force is applied to the anti-extrusion element 5 in the axial direction, this force induces radial expansion of the anti-extrusion element 5 as well as a corresponding stretching of the plurality of springs 20. More specifically, the application of this force pushes the series of outer segments 15 onto the setting tool (e.g., a shoe) which causes the anti-extrusion element 5 to expand radially. This axial force is transmitted onto the other side of the anti-extrusion element 5 to the sealing element 35 and the continued application of the axial force also transmits through the sealing element 35 causing the second anti-extrusion element 5 on the other side of the sealing element 35 to also expand radially. As the anti-extrusion elements 5 expand radially, they contact an adjacent surface (e.g., a casing) and reduce the extrusion gap for the material of the sealing element 35 to extrude through. When both anti-extrusion elements 5 are radially expanded, the sealing element 35 is compressed upon application of further axial force thereby inducing radial expansion of the sealing element 35. The sealing element 35 is compressed and expanded last as the stiffness of the sealing element 35 material is greater than the stiffness of the plurality of springs 20 of the anti-extrusion elements 5. In some examples, the timing of the expansion of the anti-extrusion elements 5 and the sealing element 35 may be set as desired by varying the stiffness of the individual components. Upon removal of the applied axial force, the anti-extrusion element 5 resets to its unexpanded state due to the force of the plurality of springs 20 pulling back to their unstretched state. This reversion allows for the anti-extrusion elements 5 and the sealing element 35 to be set, unset, and then reset as desired.

It should be clearly understood that the example anti-extrusion elements 5 illustrated by FIG. 1 are merely a general application of the principles of this disclosure in practice, and a wide variety of other examples are possible. Therefore, the scope of this disclosure is not limited in any manner to the details of FIG. 1 as described herein.

Figure 2:
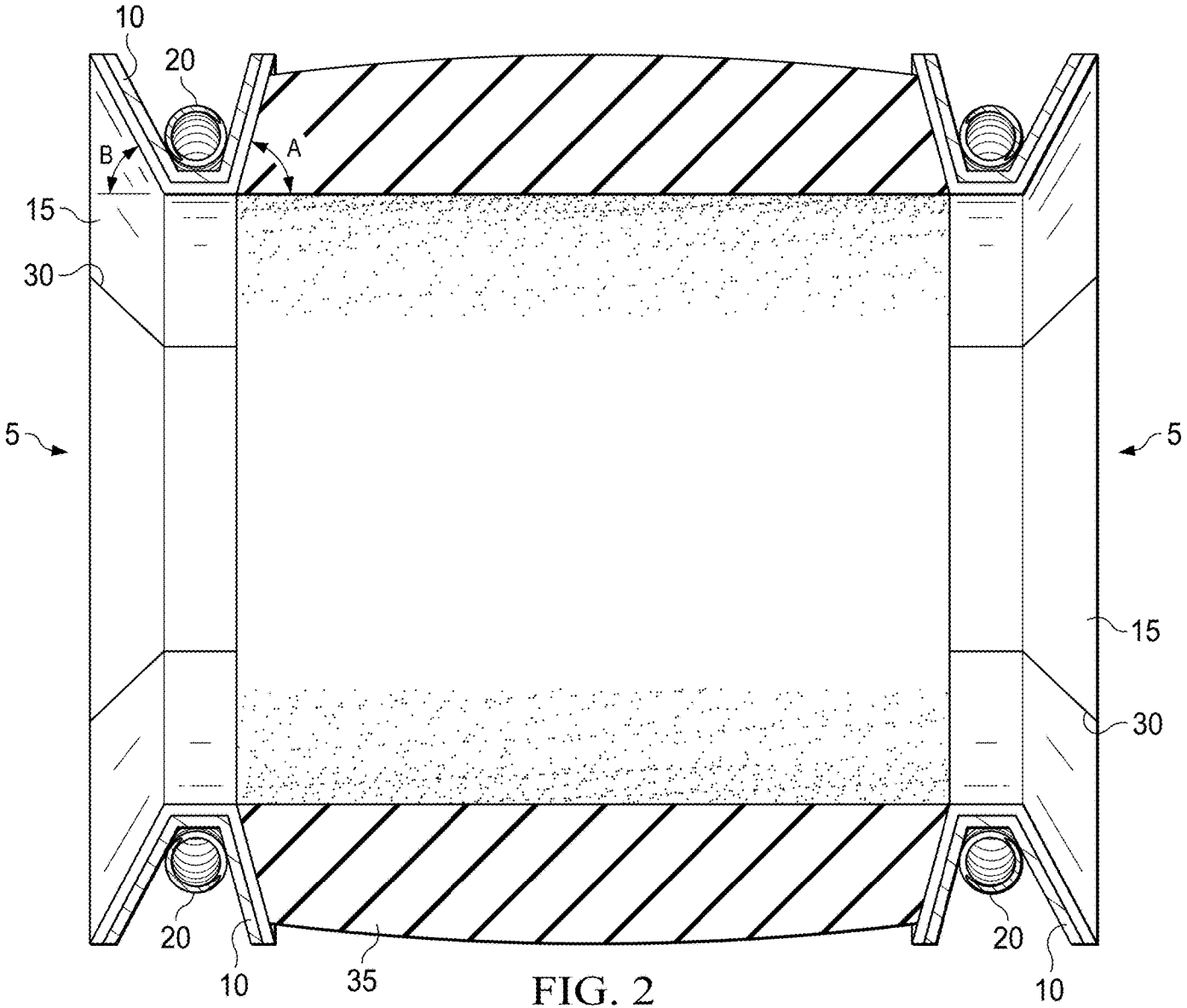
FIG. 2 is a cross-section of the anti-extrusion element of FIG. 1 in accordance with one or more examples described herein.

FIG. 2 is a cross-section of the anti-extrusion element 5 of FIG. 1. In the illustration of FIG. 2, the series of overlapping inner segments 10 are nested in the slots of the series of overlapping outer segments 15 and the plurality of springs 20 are disposed within the slots of the inner segments 10. The bend of the series of inner segments 10 and outer segments 15 can be any shape sufficient for allowing radial expansion of the anti-extrusion element 5. In the illustration of FIG. 2, the slot is shaped generally as a V-shape, but other shapes may be made through alterations in the bend shape such as having a U-shaped slot. As illustrated, the slots of the series of inner segments 10 and outer segments 15 open and face radially outward away from the looped structure of the anti-extrusion element 5.

With continued reference to FIG. 2, the slots of the series of outer segments 15 form an angle, angle A, that represents the angle of contact of the exterior of the series of outer segments 15 with the sealing element 35. Additionally, the slots of the series of outer segments 15 form another angle, angle B, that represents the angle of contact of the exterior of the series of outer segments 15 with the setting tool used to apply the setting force to the sealing element 35 (e.g., a shoe). When the setting force is applied, the setting tool applies a force on the series of outer segments 15 and due to the degree of angle B, the series of outer segments 15 ride onto the setting tool, which then causes the anti-extrusion element 5 to expand radially. As the stiffness of the material of the sealing element 35 is higher than the stiffness of the plurality of springs 20, the axial force applied on the anti-extrusion element 5 is transmitted onto the other side of the sealing element 35 to the far anti-extrusion element 5, causing it to also expand radially. When both of the anti-extrusion elements 5 expand radially, the sealing element may then be compressed to expand radially upon continued application of the axial force from the setting tool. The anti-extrusion elements 5 and the sealing element 35 contact an adjacent surface and the anti-extrusion elements 5 may reduce the potential extrusion gap minimizing or preventing extrusion of the material of the sealing element 35. The angles A and B may be adjusted as desired to time the deployment of the anti-extrusion elements 5 prior to compressing the sealing element 35. The combination of angles A and B alongside the material stiffness controls which of the anti-extrusion elements 5 and the sealing element 35 would be deployed first. For example, if angle A is greater than 90°, the sealing element 35 would be deployed before the anti-extrusion elements 5.

It should be clearly understood that the example anti-extrusion element 5 illustrated by FIG. 2 is merely a general application of the principles of this disclosure in practice, and a wide variety of other examples are possible. Therefore, the scope of this disclosure is not limited in any manner to the details of FIG. 2 as described herein.

Figure 3:
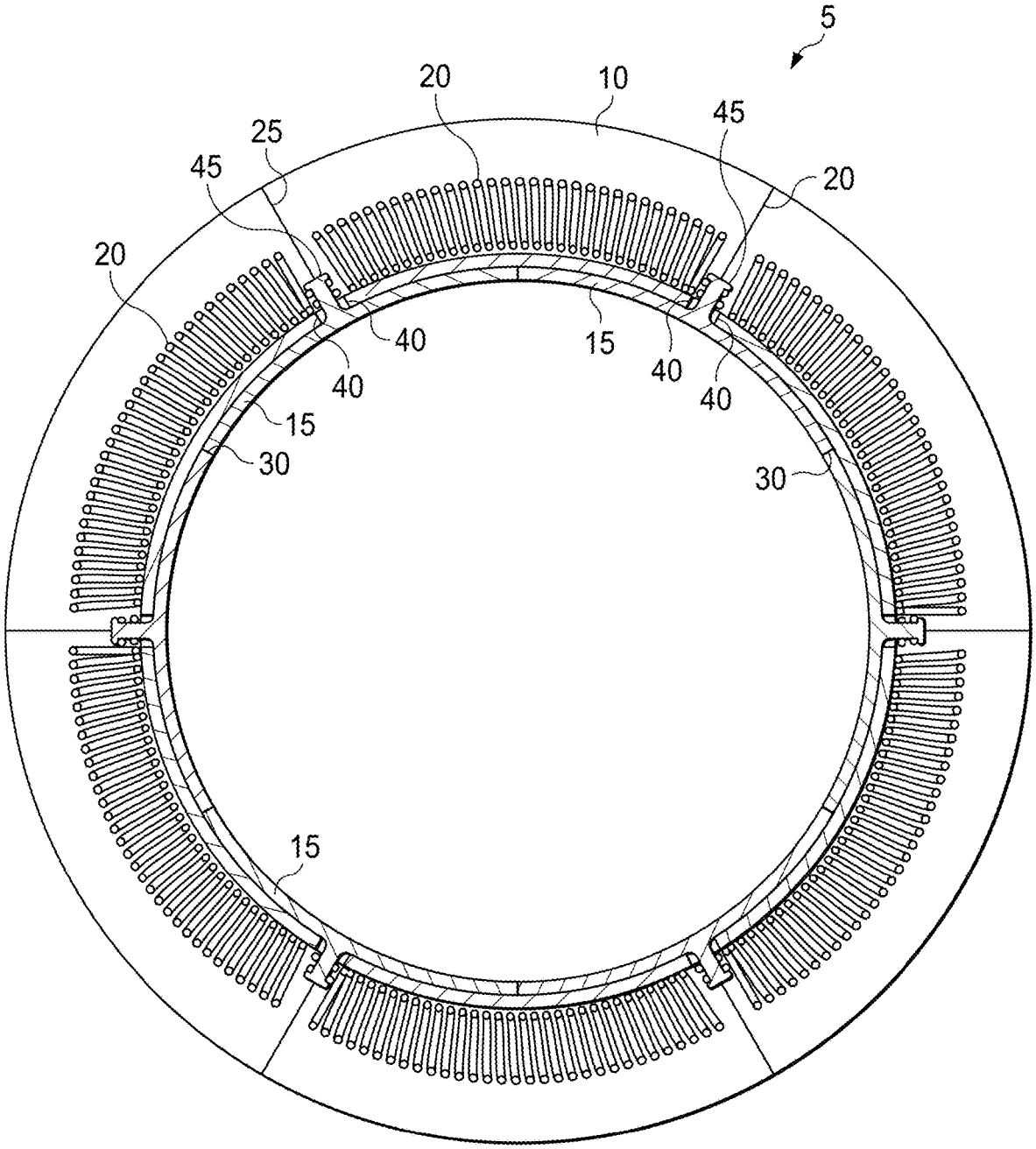
FIG. 3 is another cross-section of the anti-extrusion element of FIGS. 1 and 2 in accordance with one or more examples described herein.

FIG. 3 is a cross-section of the anti-extrusion element 5 of FIGS. 1 and 2. In the illustration of FIG. 3, each end 25 of the inner segments 10 comprises a groove 40. The groove 40 of one end 25 of each inner segment 10 aligns with a corresponding groove 40 of an end 25 of the adjacent inner segment 10 to form an opening where one end 25 of each inner segment 10 in the series meets the end 25 of the adjacent inner segment 10. Each outer segment 15 in the series comprises a peg 45 within the slot of each outer segment 15 and each peg 45 faces radially outward from the loop formed of the series of outer segments 15. The opening in the ends 25 of adjacent inner segments 10 is used to allow a peg 45 to protrude through the series of inner segments 10. Specifically, each one of the pegs 45 in the series of outer segments 15 aligns with one of the corresponding openings of the series of inner segments 10 such that one peg 45 in the series of outer segments 15 protrudes through one opening in the series of inner segments 10. Each of the springs 20 in the plurality are coupled to two of the pegs 45 of the series of outer segments 15 with each end of one spring 20 coupled to an individual peg 45. This arrangement links springs 20 to the outer segments 15 such that when the outer segments 15 ride on to the setting tool as an axial force is applied to the anti-extrusion element 5, the expanding loop of outer segments also stretches the springs 20 linked to the pegs 45 as the anti-extrusion element 5 radially expands.

It should be clearly understood that the example anti-extrusion element 5 illustrated by FIG. 3 is merely a general application of the principles of this disclosure in practice, and a wide variety of other examples are possible. Therefore, the scope of this disclosure is not limited in any manner to the details of FIG. 3 as described herein.

Figure 4:
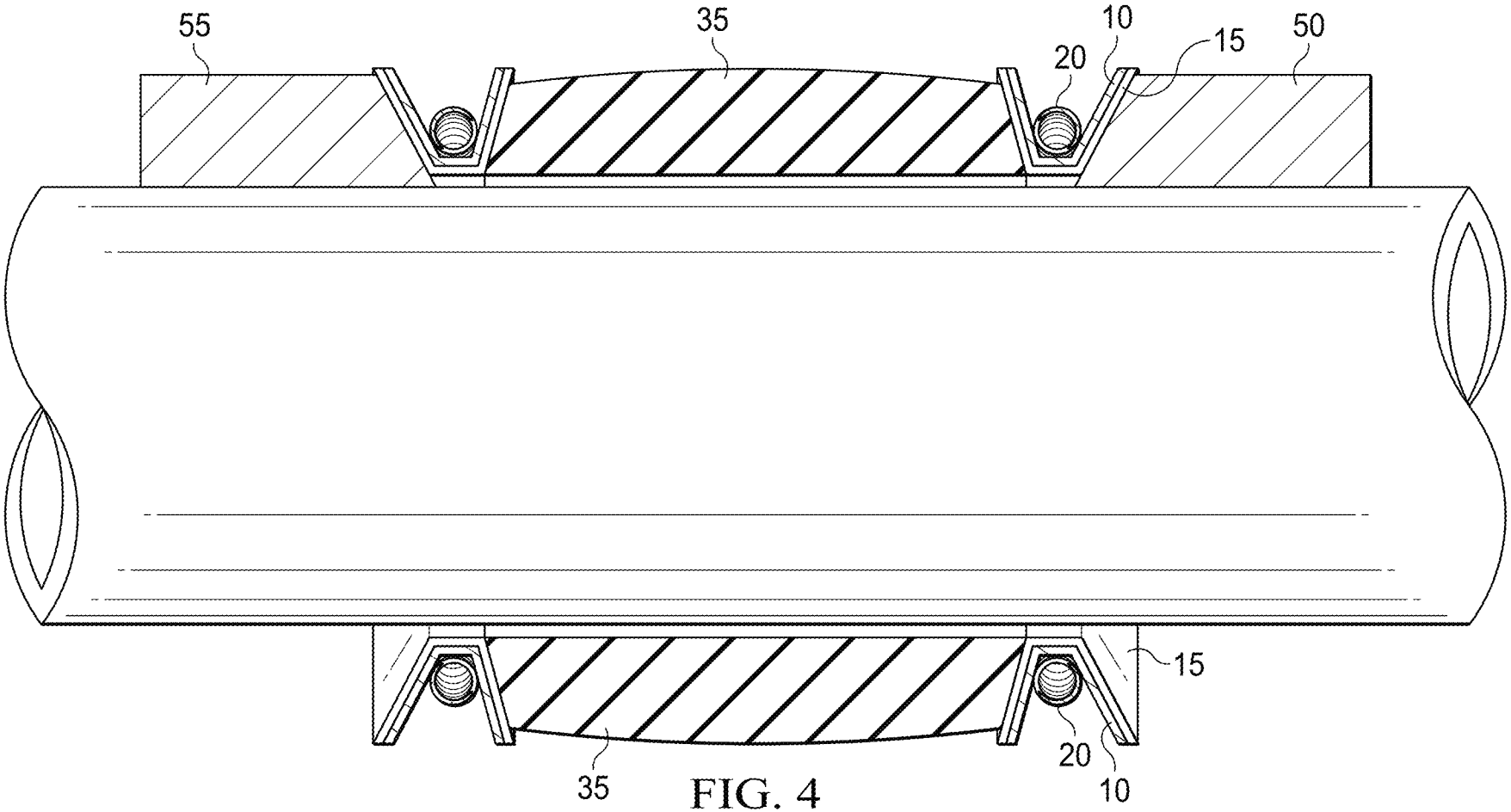
FIG. 4 is an illustration of the anti-extrusion elements of FIGS. 1-3 when used to minimize or prevent extrusion of the material of a sealing element in accordance with one or more examples described herein.

FIG. 4 is an illustration of the anti-extrusion elements 5 of FIGS. 1-3 when used to minimize or prevent extrusion of the material of a sealing element 35 after setting when installed on a mandrel or other tubular. In the illustration of FIG. 4, setting tool 50 is engaged to contact the exterior of the series of outer segments 15 and then apply a force in the axially direction to the rightmost anti-extrusion element 5. Structure 55 contacts the series of outer segments 15 on the leftmost anti-extrusion element 5 and may be another setting tool or a hard immobile structure which may prevent movement of the anti-extrusion elements 5 and the sealing element 35 when a setting force is applied.

Figure 5:
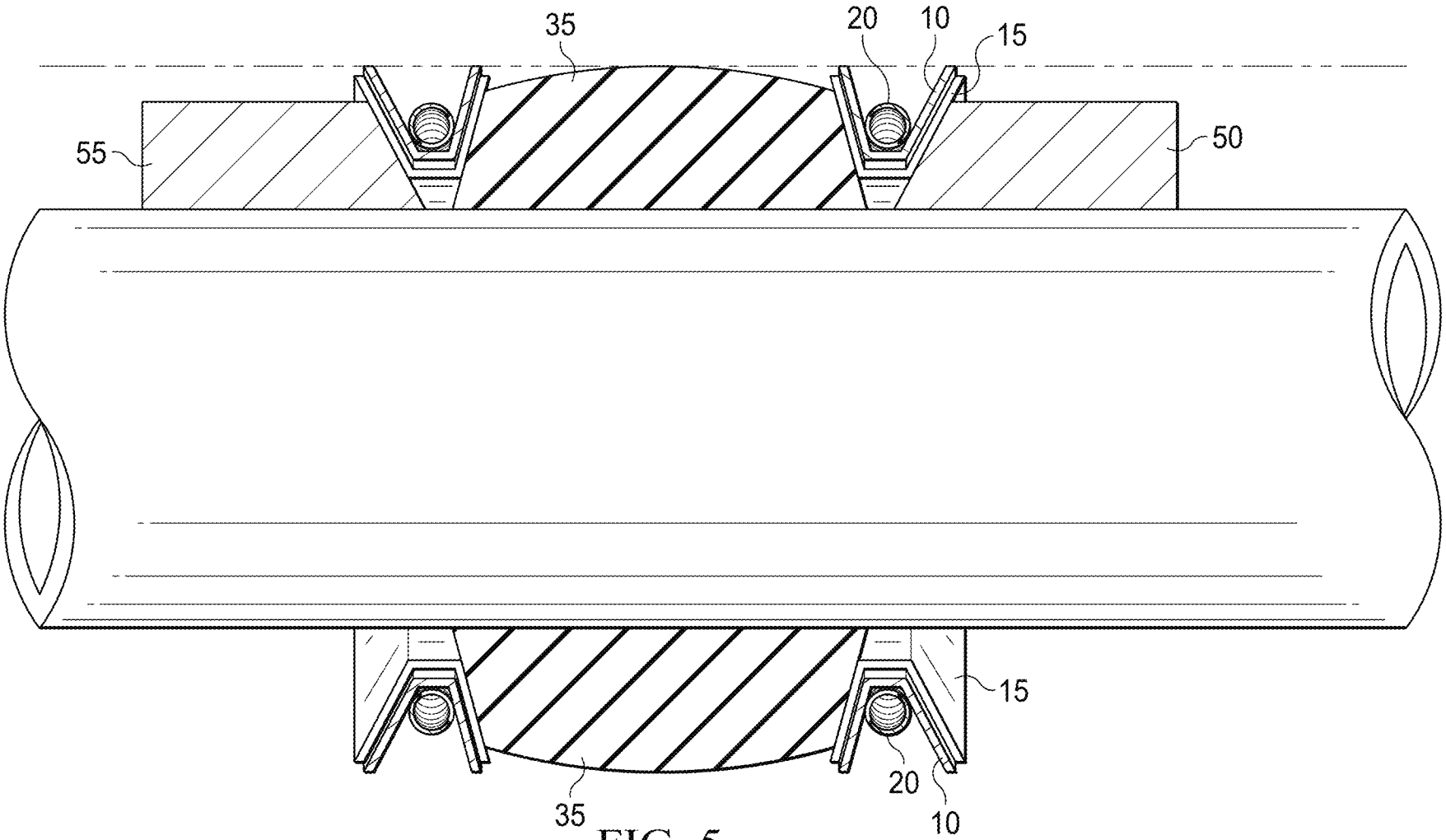
FIG. 5 is continuation of the illustration of FIG. 4 in accordance with one or more examples described herein.

FIG. 5 is an illustration continuing the actuation of the anti-extrusion elements 5 and sealing element 35 of FIG. 4. In the illustration of FIG. 5, setting tool 50 has applied a sufficient setting force in the axial direction to the rightmost anti-extrusion element 5 to radially expand the rightmost anti-extrusion element 5. A continued application of force has also been transmitted through the sealing element 35 to expand the leftmost anti-extrusion element 5 and then the sealing element 35 until the anti-extrusion elements 5 and the sealing element 35 have contacted an adjacent surface. The adjacent surface is illustrated in FIG. 5 as the exterior surface of the inner diameter of a casing, but may be any wellbore surface in which a seal is desired. Expansion of the sealing element 35 seals and isolates the zones on either side of the sealing element 35. Differential pressure applied to the sealing element 35 may attempt to extrude the material of the sealing element 35; however, the expansion of the anti-extrusion elements 5 may minimize or prevent this extrusion.

The sealing element 35 and the anti-extrusion elements 5 may be reset by removal of the applied force from the setting tool 50. The elastic properties of the sealing element 35 may revert the sealing element 35 to its decompressed state. Similarly, the plurality of springs 20 of the anti-extrusion elements 5 may revert the anti-extrusion elements 5 to their unexpanded state. The entire assembly may then be retrieved by removal of the underlying wellbore conduit or through the use of a retrieval tool. Alternatively, the sealing element 35 and the anti-extrusion elements 5 may also be reset when desired by a new application of axial force via the setting tool 50 or other such setting element.

It should be clearly understood that the example systems illustrated by FIGS. 4 and 5 are merely a general application of the principles of this disclosure in practice, and a wide variety of other examples are possible. Therefore, the scope of this disclosure is not limited in any manner to the details of FIGS. 4 and 5 as described herein.

Figure 6:
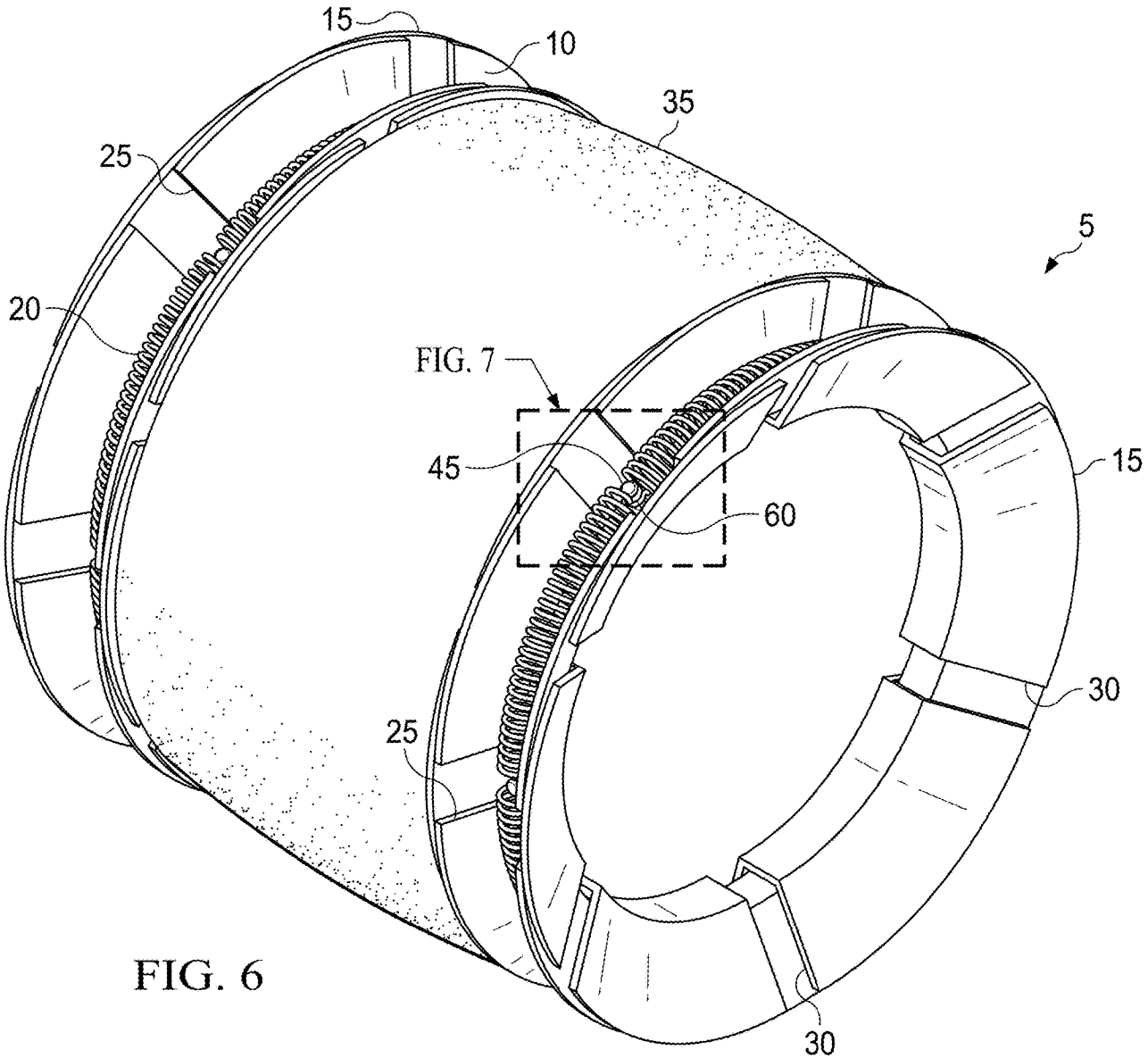
FIG. 6 is a perspective drawing of the two example anti-extrusion elements of FIG. 1 after expansion in accordance with one or more examples described herein.

FIG. 6 illustrates a perspective drawing of two example anti-extrusion elements, generally 5 on opposing sides of sealing element 35 after the radial expansion of the sealing element 35 and the anti-extrusion elements 5. In the illustration, the series of overlapping inner segments 10 and the series of overlapping outer segments 15 have been pushed radially outward. As the series of inner segments 10 and the series of outer segments 15 overlap, the gap between these series after expansion remains covered to prevent or reduce extrusion of the sealing element 35 through the gap. The plurality of springs 20 has stretched radially outward from the application of force to the anti-extrusion element 5 in the axial direction. Specifically, the application of this force has pushed the series of outer segments 15 onto the setting tool (e.g., a shoe) which has caused the anti-extrusion element 5 to expand radially. This axial force was then transmitted onto the other side of the anti-extrusion element 5 to the sealing element 35 and the continued application of the axial force also transmits through the sealing element 35 causing the second anti-extrusion element 5 on the other side of the sealing element 35 to also expand radially which was followed by the sealing element 35.

It should be clearly understood that the example anti-extrusion elements 5 illustrated by FIG. 6 are merely a general application of the principles of this disclosure in practice, and a wide variety of other examples are possible. Therefore, the scope of this disclosure is not limited in any manner to the details of FIG. 6 as described herein.

Figure 7:
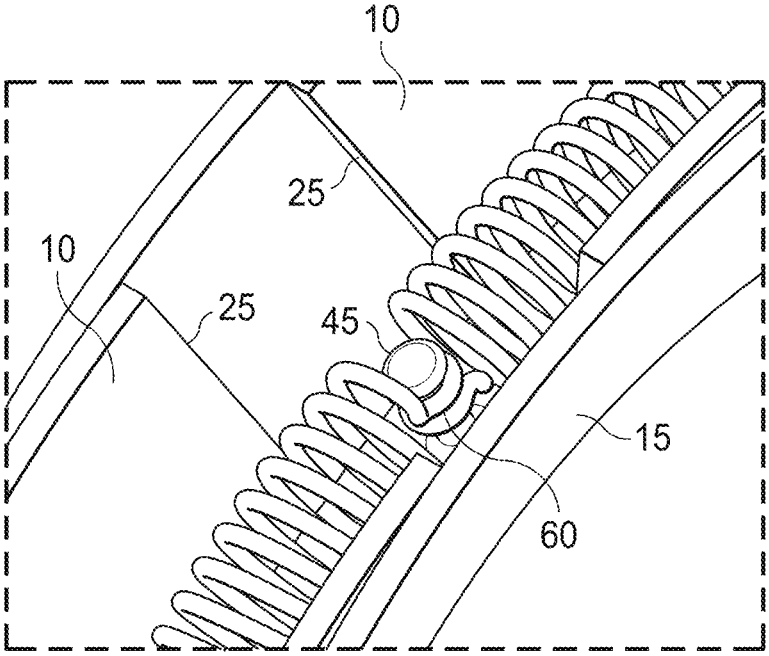
FIG. 7 is an enlarged view of the coupling of the spring to the peg as shown in FIGS. 1 and 6 in accordance with one or more examples described herein.

FIG. 7 is an enlarged view of the pegs 45 as coupled to the springs 20 as shown in FIGS. 1 and 6. A coupling 60 is used to couple the springs 20 to the pegs. In some examples, springs 20 may be hooked onto the pegs 45 if springs 20 comprise looped ends as shown in the illustration. Alternatively, springs 20 may be welded, soldered, or even adhered to the pegs 45 with an adhesive. In one specific example, each spring in the plurality of springs 20 is a garter spring and each garter spring is hooked to two pegs 45.

It should be clearly understood that the example illustrated by FIG. 7 is merely a general application of the principles of this disclosure in practice, and a wide variety of other examples are possible. Therefore, the scope of this disclosure is not limited in any manner to the details of FIG. 7 as described herein.

In some optional examples, a mesh or other material may be placed between the anti-extrusion element and the sealing element. The mesh may be used to reduce pinch points in the overlapping series of outer segments so as to minimize the pinching of the material of the sealing element as it is pressed against the series of outer segments. An example mesh may be made of an elastomer or other polymeric material that can expand with the anti-extrusion element. Other expansive materials may be used in addition to or as a substitute for the mesh which may function as a buffer material between the anti-extrusion element and the sealing element. Likewise, in some optional examples, the inner segments and/or the outer segments may be tapered at their ends which may reduce pinch points where the segments contact, The inner segments disclosed herein may comprise any sufficient material for minimizing or preventing extrusion of the sealing element material. Examples of the material for the inner segments may include, but is not limited to, nickel-chromium-based superalloys, low alloy steel such as steel alloys containing less than 10% of chromium, molybdenum, vanadium, and nickel; chrome steel, high strength composite materials such as fiber reinforced composites including those having fibers composed of glass, carbon, aramid, metal, polyethylene, polypropylene, and the like. Other examples for the material of the inner segments include thermoplastic resins including, but not limited to, polyetheretherketone (PEEK), polytetrafluoroethylene (PTFE), urethanes, polyethyleneimine (PEI), polyphenylene sulfide (PPS). Still other examples include, but are not limited to, thermosetting resins such as epoxies, phenolics, and the like. Combinations of materials including, but not limited to, those listed above may also be used in some examples.

The outer segments disclosed herein may comprise any sufficient material for minimizing or preventing extrusion of the sealing element material. Examples of the material for the outer segments may include, but is not limited to, nickel-chromium-based superalloys, low alloy steel such as steel alloys containing less than 10% of chromium, molybdenum, vanadium, and nickel; chrome steel, high strength composite materials such as fiber reinforced composites including those having fibers composed of glass, carbon, aramid, metal, polyethylene, polypropylene, and the like. Other examples for the material of the inner segments include thermoplastic resins including, but not limited to, polyetheretherketone (PEEK), polytetrafluoroethylene (PTFE), urethanes, polyethyleneimine (PEI), polyphenylene sulfide (PPS). Still other examples include, but are not limited to, thermosetting resins such as epoxies, phenolics, and the like. Combinations of materials including, but not limited to, those listed above may also be used in some examples.

The springs disclosed herein may comprise any sufficient elastic element for reverting a radially expanded anti-extrusion element. Examples of the springs may include, but are not limited to, garter springs, rubber bands or similar elastic elements, or a single torsional spring stretching along the circumference of the anti-extrusion element.

The anti-extrusion elements may be used to prevent extrusion of a variety of sealing elements including, but not limited to those comprising elastomers, rubbers, rubber composites such as those reinforced with fibers/fabric, and the like.

The anti-extrusion elements disclosed herein may directly or indirectly affect one or more components or pieces of equipment associated with or which may come into contact with the anti-extrusion elements such as, but not limited to, wellbore casing, wellbore liner, completion string, insert strings, drill string, coiled tubing, slickline, wireline, drill pipe, drill collars, mud motors, downhole motors and/or pumps such as electric submersible pumps (ESPs), cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), jetting tools, sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

Provided are anti-extrusion elements in accordance with the disclosure and the illustrated FIGs. An example anti-extrusion element comprises a series of inner segments with each inner segment in the series being adjacent to another inner segment in the series to form a loop of inner segments. Each of the inner segments in the series is bent to form a slot running along a circumference of the anti-extrusion element and the slot opens and faces radially outward away from the loop. Each inner segment has two ends disposed on opposing sides of an axial length of each inner segment and each end comprises a groove. The groove of one end of each inner segment aligns with a corresponding groove of an end of an adjacent inner segment so as to form an opening. The anti-extrusion element further comprises a series of outer segments with each outer segment in the series being adjacent to another outer segment in the series to form a loop of outer segments. Each of the outer segments in the series is bent to form a slot running along the circumference of the anti-extrusion element and the slot opens and faces radially outward away from the loop. The series of inner segments is nested within the slot of the series of outer segments. Each outer segment in the series comprises a peg within the slot. Each peg faces radially outward from the loop formed of the series of outer segments. Each of the pegs in the series of outer segments aligns with one of the openings of the series of inner segments such that one peg in the series of outer segments protrudes through one opening in the series of inner segments. The anti-extrusion element further comprises a plurality of springs disposed in the slot of the inner segments. The springs in the plurality are coupled to the pegs of the series of outer segments.

Additionally, or alternatively, the anti-extrusion element may include one or more of the following features individually or in combination. Each inner segment may comprise a material selected from the group consisting of nickel-chromium-based superalloys; low alloy steel containing less than 10% of chromium, molybdenum, vanadium, and/or nickel, chrome steel; composite materials, thermoplastic resins; thermosetting resins; and any combination thereof. Each outer segment may comprise a material selected from the group consisting of nickel-chromium-based superalloys; low alloy steel containing less than 10% of chromium, molybdenum, vanadium, and/or nickel, chrome steel; composite materials, thermoplastic resins; thermosetting resins; and any combination thereof. The anti-extrusion element may be disposed on a conduit with the loop of the series of outer segments disposed around an exterior of the conduit. A sealing element may be disposed on the conduit and is positioned adjacent to the anti-extrusion element. A mesh may be placed between the anti-extrusion element and the sealing element. Each spring in the plurality of springs may be a garter spring and each garter spring is coupled to two pegs.

Provided are methods for sealing in a wellbore in accordance with the disclosure and the illustrated FIGs. An example method comprises introducing a packer assembly into a wellbore, wherein the packer assembly comprises a conduit, a sealing element disposed on the conduit and positioned adjacent to the anti-extrusion element, and an anti-extrusion element. The anti-extrusion element comprises a series of inner segments with each inner segment in the series being adjacent to another inner segment in the series to form a loop of inner segments. Each of the inner segments in the series is bent to form a slot running along a circumference of the anti-extrusion element and the slot opens and faces radially outward away from the loop. Each inner segment has two ends disposed on opposing sides of an axial length of each inner segment and each end comprises a groove. The groove of one end of each inner segment aligns with a corresponding groove of an end of an adjacent inner segment so as to form an opening. The anti-extrusion element further comprises a series of outer segments with each outer segment in the series being adjacent to another outer segment in the series to form a loop of outer segments. Each of the outer segments in the series is bent to form a slot running along the circumference of the anti-extrusion element and the slot opens and faces radially outward away from the loop. The series of inner segments is nested within the slot of the series of outer segments. Each outer segment in the series comprises a peg within the slot. Each peg faces radially outward from the loop formed of the series of outer segments. Each of the pegs in the series of outer segments aligns with one of the openings of the series of inner segments such that one peg in the series of outer segments protrudes through one opening in the series of inner segments. The anti-extrusion element further comprises a plurality of springs disposed in the slot of the inner segments. The springs in the plurality are coupled to the pegs of the series of outer segments. The method further comprises applying a force to the anti-extrusion element. The force compresses the anti-extrusion element and the adjacent sealing element to expand the anti-extrusion element and the sealing element radially. The method further comprises contacting an adjacent surface in the wellbore with the compressed sealing element.

Additionally, or alternatively, the method may include one or more of the following features individually or in combination. The method may further comprise removing the force to the anti-extrusion element and the anti-extrusion element and the sealing element revert to a decompressed state upon removal of the force. The method may further comprise reapplying the force to the anti-extrusion element to compress the anti-extrusion element and the adjacent sealing element. Each inner segment may comprise a material selected from the group consisting of nickel-chromium-based superalloys; low alloy steel containing less than 10% of chromium, molybdenum, vanadium, and/or nickel, chrome steel; composite materials, thermoplastic resins; thermosetting resins; and any combination thereof. Each outer segment may comprise a material selected from the group consisting of nickel-chromium-based superalloys; low alloy steel containing less than 10% of chromium, molybdenum, vanadium, and/or nickel, chrome steel; composite materials, thermoplastic resins; thermosetting resins;

and any combination thereof. The anti-extrusion element may be disposed on a conduit with the loop of the series of outer segments disposed around an exterior of the conduit. A sealing element may be disposed on the conduit and is positioned adjacent to the anti-extrusion element. A mesh may be placed between the anti-extrusion element and the sealing element. Each spring in the plurality of springs may be a garter spring and each garter spring is coupled to two pegs.

Provided are systems for sealing in a wellbore in accordance with the disclosure and the illustrated FIGs. An example system comprises a conduit, a sealing element disposed on the conduit and positioned adjacent to an anti-extrusion element, and the anti-extrusion element comprising a series of inner segments with each inner segment in the series being adjacent to another inner segment in the series to form a loop of inner segments. Each of the inner segments in the series is bent to form a slot running along a circumference of the anti-extrusion element and the slot opens and faces radially outward away from the loop. Each inner segment has two ends disposed on opposing sides of an axial length of each inner segment and each end comprises a groove. The groove of one end of each inner segment aligns with a corresponding groove of an end of an adjacent inner segment so as to form an opening. The anti-extrusion element further comprises a series of outer segments with each outer segment in the series being adjacent to another outer segment in the series to form a loop of outer segments. Each of the outer segments in the series is bent to form a slot running along the circumference of the anti-extrusion element and the slot opens and faces radially outward away from the loop. The series of inner segments is nested within the slot of the series of outer segments. Each outer segment in the series comprises a peg within the slot. Each peg faces radially outward from the loop formed of the series of outer segments. Each of the pegs in the series of outer segments aligns with one of the openings of the series of inner segments such that one peg in the series of outer segments protrudes through one opening in the series of inner segments. The anti-extrusion element further comprises a plurality of springs disposed in the slot of the inner segments. The springs in the plurality are coupled to the pegs of the series of outer segments.

Additionally, or alternatively, the system may include one or more of the following features individually or in combination. The system may further comprise a setting tool configured to apply a force to the anti-extrusion element. The setting tool may be configured to apply the force to the anti-extrusion element from a position opposite of the sealing element such that the adjacent sealing element is compressed by the force as the anti-extrusion element is pressed against the sealing element. Each inner segment may comprise a material selected from the group consisting of nickel-chromium-based superalloys; low alloy steel containing less than 10% of chromium, molybdenum, vanadium, and/or nickel, chrome steel; composite materials, thermoplastic resins; thermosetting resins; and any combination thereof. Each outer segment may comprise a material selected from the group consisting of nickel-chromium-based superalloys; low alloy steel containing less than 10% of chromium, molybdenum, vanadium, and/or nickel, chrome steel; composite materials, thermoplastic resins; thermosetting resins; and any combination thereof. A mesh may be placed between the anti-extrusion element and the sealing element. Each spring in the plurality of springs may be a garter spring and each garter spring is coupled to two pegs.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. An anti-extrusion element comprising:

a series of inner segments with each inner segment in the series being adjacent to another inner segment in the series to form a loop of inner segments; wherein each of the inner segments in the series is bent to form a slot running along a circumference of the anti-extrusion element and wherein the slot opens and faces radially outward away from the loop; wherein each inner segment has two ends disposed on opposing sides of an axial length of each inner segment and each end comprises a groove; wherein the groove of one end of each inner segment aligns with a corresponding groove of an end of an adjacent inner segment so as to form an opening;

a series of outer segments with each outer segment in the series being adjacent to another outer segment in the series to form a loop of outer segments; wherein each of the outer segments in the series is bent to form a slot running along the circumference of the anti-extrusion element and wherein the slot opens and faces radially outward away from the loop; wherein the series of inner segments is nested within the slot of the series of outer segments; wherein each outer segment in the series comprises a peg within the slot; wherein each peg faces radially outward from the loop formed of the series of outer segments; wherein each of the pegs in the series of outer segments aligns with one of the openings of the series of inner segments such that one peg in the series of outer segments protrudes through one opening in the series of inner segments; and a plurality of springs disposed in the slot of the inner segments; wherein the springs in the plurality are coupled to the pegs of the series of outer segments.

2. The anti-extrusion element of claim 1, wherein each inner segment comprises a material selected from the group consisting of nickel-chromium-based superalloys; low alloy steel containing less than 10% of chromium, molybdenum, vanadium, and/or nickel; chrome steel; composite materials, thermoplastic resins; thermosetting resins; and any combination thereof.

3. The anti-extrusion element of claim 1, wherein each outer segment comprises a material selected from the group consisting of nickel-chromium-based superalloys; low alloy steel containing less than 10% of chromium, molybdenum, vanadium, and/or nickel; chrome steel; composite materials; thermoplastic resins; thermosetting resins; and any combination thereof.

4. The anti-extrusion element of claim 1, wherein the anti-extrusion element is disposed on a conduit with the loop of the series of outer segments disposed around an exterior of the conduit.

5. The anti-extrusion element of claim 4, wherein a sealing element is disposed on the conduit and is positioned adjacent to the anti-extrusion element.

6. The anti-extrusion element of claim 5, wherein a mesh is placed between the anti-extrusion element and the sealing element.

7. The anti-extrusion element of claim 1, wherein each spring in the plurality of springs is a garter spring and each garter spring is coupled to two pegs.

8. A method for sealing in a wellbore, the method comprises:

introducing a packer assembly into a wellbore, wherein the packer assembly comprises:

a conduit, a sealing element disposed on the conduit and positioned adjacent to an anti-extrusion element, and the anti-extrusion element comprising:

a series of inner segments with each inner segment in the series being adjacent to another inner segment in the series to form a loop of inner segments; wherein each of the inner segments in the series is bent to form a slot running along a circumference of the anti-extrusion element and wherein the slot opens and faces radially outward away from the loop; wherein each inner segment has two ends disposed on opposing sides of an axial length of each inner segment and each end comprises a groove; wherein the groove of one end of each inner segment aligns with a corresponding groove of an end of an adjacent inner segment so as to form an opening;

a series of outer segments with each outer segment in the series being adjacent to another outer segment in the series to form a loop of outer segments; wherein each of the outer segments in the series is bent to form a slot running along the circumference of the anti-extrusion element and wherein the slot opens and faces radially outward away from the loop; wherein the series of inner segments is nested within the slot of the series of outer segments; wherein each outer segment in the series comprises a peg within the slot; wherein each peg faces radially outward from the loop formed of the series of outer segments; wherein each of the pegs in the series of outer segments aligns with one of the openings of the series of inner segments such that one peg in the series of outer segments protrudes through one opening in the series of inner segments; and a plurality of springs disposed in the slot of the inner segments; wherein the springs in the plurality are coupled to the pegs of the series of outer segments;

applying a force to the anti-extrusion element; wherein the force compresses the anti-extrusion element and the adjacent sealing element to expand the anti-extrusion element and the sealing element radially; and contacting an adjacent surface in the wellbore with the compressed sealing element.

9. The method of claim 8, further comprising removing the force to the anti-extrusion element; wherein the anti-extrusion element and the sealing element revert to a decompressed state upon removal of the force.

10. The method of claim 9, further comprising reapplying the force to the anti-extrusion element to compress the anti-extrusion element and the adjacent sealing element.

11. The method of claim 8, wherein each inner segment comprises a material selected from the group consisting of nickel-chromium-based superalloys; low alloy steel containing less than 10% of chromium, molybdenum, vanadium, and/or nickel; chrome steel; composite materials, thermoplastic resins; thermosetting resins; and any combination thereof.

12. The method of claim 8, wherein each outer segment comprises a material selected from the group consisting of nickel-chromium-based superalloys; low alloy steel containing less than 10% of chromium, molybdenum, vanadium, and/or nickel; chrome steel; composite materials, thermoplastic resins; thermosetting resins; and any combination thereof.

13. The method of claim 8, wherein a mesh is placed between the anti-extrusion element and the sealing element.

14. The method of claim 8, each spring in the plurality of springs is a garter spring and each garter spring is coupled to two pegs.

15. A system for sealing in a wellbore, the system comprises:

a conduit, a sealing element disposed on the conduit and positioned adjacent to an anti-extrusion element, and the anti-extrusion element comprising:

a series of inner segments with each inner segment in the series being adjacent to another inner segment in the series to form a loop of inner segments; wherein each of the inner segments in the series is bent to form a slot running along a circumference of the anti-extrusion element and wherein the slot opens and faces radially outward away from the loop; wherein each inner segment has two ends disposed on opposing sides of an axial length of each inner segment and each end comprises a groove; wherein the groove of one end of each inner segment aligns with a corresponding groove of an end of an adjacent inner segment so as to form an opening;

a series of outer segments with each outer segment in the series being adjacent to another outer segment in the series to form a loop of outer segments; wherein each of the outer segments in the series is bent to form a slot running along the circumference of the anti-extrusion element and wherein the slot opens and faces radially outward away from the loop; wherein the series of inner segments is nested within the slot of the series of outer segments; wherein each outer segment in the series comprises a peg within the slot; wherein each peg faces radially outward from the loop formed of the series of outer segments; wherein each of the pegs in the series of outer segments aligns with one of the openings of the series of inner segments such that one peg in the series of outer segments protrudes through one opening in the series of inner segments; and a plurality of springs disposed in the slot of the inner segments; wherein the springs in the plurality are coupled to the pegs of the series of outer segments.

16. The system of claim 15, further comprising a setting tool configured to apply a force to the anti-extrusion element.

17. The system of claim 16, wherein the setting tool is configured to apply the force to the anti-extrusion element from a position opposite of the sealing element such that the adjacent sealing element is compressed by the force as the anti-extrusion element is pressed against the sealing element.

18. The system of claim 15, wherein each inner segment comprises a material selected from the group consisting of nickel-chromium-based superalloys; low alloy steel containing less than 10% of chromium, molybdenum, vanadium, and/or nickel; chrome steel; composite materials, thermoplastic resins; thermosetting resins; and any combination thereof.

19. The system of claim 15, wherein each outer segment comprises a material selected from the group consisting of nickel-chromium-based superalloys; low alloy steel containing less than 10% of chromium, molybdenum, vanadium, and/or nickel; chrome steel; composite materials, thermoplastic resins; thermosetting resins; and any combination thereof.

20. The system of claim 15, wherein a mesh is placed between the anti-extrusion element and the sealing element.

* * * * *